US005454658A

United States Patent [19]

Kato

[11] Patent Number: 5,454,658

[45] Date of Patent: Oct. 3, 1995

[54] REAR END KNOCKING TYPE LIQUID DISCHARGE APPARATUS

[75] Inventor: Naoki Kato, Ishioka, Japan

[73] Assignee: Pentel Kabushiki Kaisha, Tokyo, Japan

[21] Appl. No.: 124,216

[22] Filed: Sep. 21, 1993

Related U.S. Application Data

[63] Continuation-in-part of Ser. No. 917,105, Aug. 5, 1992, abandoned.

[30] Foreign Application Priority Data

Jan. 31, 1991 [JP] Japan ..... 3-9247

[51] Int. Cl.[6] ..... B43K 8/04; A46B 11/00

[52] U.S. Cl. ..... 401/205; 401/278; 401/279

[58] Field of Search ..... 401/205, 278, 401/153, 279

[56] References Cited

U.S. PATENT DOCUMENTS

| | | | |
|---|---|---|---|
| 3,682,59 | 8/1972 | Hirota | 401/205 X |
| 1,413,827 | 4/1922 | Briggs | 401/205 |
| 4,930,923 | 6/1990 | Reichnann et al. | 401/205 X |

FOREIGN PATENT DOCUMENTS

| | | | |
|---|---|---|---|
| 168197 | 4/1951 | Austria | 401/153 |
| 2637856 | 3/1978 | Germany | 401/153 |
| 3625418 | 2/1988 | Germany | 401/279 |
| 016302 | 4/1981 | Japan . | |
| 121581 | 7/1982 | Japan . | |
| 055114 | 11/1982 | Japan . | |
| 169385 | 11/1989 | Japan . | |
| WO9213646 | 8/1992 | Japan . | |
| 2193881 | 2/1988 | United Kingdom | 401/279 |

*Primary Examiner*—Steven A. Bratlie
*Attorney, Agent, or Firm*—Wenderoth, Lind & Ponack

[57] ABSTRACT

A liquid discharge apparatus has a tubular casing having an applicator at one end and an actuator button with a pressing portion at the other end. A thin wall resilient portion is integrally connected between the tubular casing and the pressing portion so that the pressing portion can be moved axially within the tubular casing. The tubular casing has a liquid chamber therewithin between the actuator button and the applicator tip, and a valve is provided having a valve body connected to the actuator button so that the valve body is movable by actuation of the actuator button. A liquid storage chamber having a recess at a rear end receives the valve body therein, the storage member being connected to a rear end of the applicator tip. A liquid discharge restriction chamber has a tube portion fitted into the recess of the liquid storage member and the tube portion has a valve seat which is resiliently engageable by the valve body.

9 Claims, 4 Drawing Sheets

REAR END KNOCKING TYPE LIQUID DISCHARGE APPARATUS

This is a continuation-in-part of application Ser. No. 07/917,105 filed Aug. 5, 1992 now abandoned.

BACKGROUND OF THE INVENTION

The present invention relates to a liquid applicator for a writing liquid, such as India ink, paint and ink, and a cosmetic liquid, such as eyeliner and lip color, and more particularly to a discharge apparatus of a rear end knocking type having a valve device between an applicator tip at a front end, such as a pen point and a liquid container storing a liquid directly and adapted to be knocked or to receive a pressure at the rear end portion of a tubular casing to open the valve device and supply the liquid to the applicator tip.

The conventional rear end knocking type liquid discharge apparatus having a valve device between an applicator tip and a liquid container storing a liquid directly and adapted to be knocked at the rear end portion of a tubular casing to open the valve device and supply the liquid to the applicator tip includes a liquid discharge apparatus having expansible bellows in a liquid storage chamber and a valve rod extending to the bottom surface of the liquid storage chamber, the valve being opened by pressing the rear end of the liquid storage chamber, as disclosed in Japanese Utility Model Publication No. 57-55114/1982. In the rear end knocking type liquid discharge apparatus, a movement of the liquid occurs suddenly, so that the liquid is liable to leak and spurt from the applicator tip.

There is also a known apparatus for preventing such leakage of liquid, as disclosed in Japanese Utility Model Publication No. 56-16302/1981. This publication shows an ink regulator for marking pens having an open ended main tubular casing portion to which a pen point or nib is fixed firmly. An ink tube is inserted slidably in the main tubular casing. A valve seat is fixed on an open portion of the ink tube, and a valve rod of a valve body is inserted slidably through a valve port made in the valve seat. An upper plate is joined at an end portion thereof to the valve port and engaged at the end portion thereof to the inner surface of the main tubular casing, and a spring is provided between the inner surface of the upper plate and the valve seat. In the liquid discharge apparatus of this structure, a liquid (marking ink) is discharged from the valve port into an ink reservoir defined by the valve seat and the upper plate, and absorbed into an ink absorber through an ink hole made in the upper plate, and the ink is then supplied gradually to the tip of the pen point owing to the capillary force of the pen point.

However, in the type of a liquid discharge apparatus in which a liquid is supplied to an applicator tip after it has once passed through a liquid absorber as in the above-described liquid discharge apparatus, it takes a long time before the liquid is supplied to the applicator tip in an initial period of time of use of the apparatus, so that the apparatus cannot be used immediately. When the rear end of a tubular casing is knocked, in spite of the presence of the liquid in the applicator tip and liquid absorber during the use of the apparatus, leakage of the liquid occurs. Moreover, in order to make the bellows provided at the rear end of the ink storage chamber expansible, it is necessary that the bellows be formed with an elastic web so as to reduce the thickness thereof. Consequently, the liquid in the storage chamber is easily passed in a gaseous state through the elastic web. Due to this passage of the liquid through the web, the viscosity of the liquid increases, and the rate of discharge of the liquid from the applicator tip decreases. This causes blurred writing and sometimes the writing of marks becomes impossible. Especially, when such a liquid discharge apparatus is sold to a consumer a long period of time after it is manufactured, the quantity of the liquid in the apparatus due to the outward permeation thereof through the elastic web decreases, so that, when the consumer first uses the apparatus, the user finds marks written therewith blurred, or finds the apparatus impossible to operate.

SUMMARY OF THE INVENTION

An object of the present invention is to provide a liquid discharge apparatus capable of supplying a liquid to an applicator tip for a short period of time at the beginning of the use of the apparatus.

Another object of the present invention is to provide a new liquid discharge apparatus which can prevent the outward permeation of a liquid through the bellows and which avoids formation of blurred written marks or failure of operation due to a decrease of the quantity of liquid in the apparatus due to the outward permeation of the liquid, at least when a consumer first uses the apparatus.

According to the present invention, there is provided a liquid discharge apparatus comprising a tubular casing having a liquid chamber in the interior thereof, an applicator tip fixed to one end of the tubular casing, and a valve means provided between the applicator tip and the liquid chamber. In the valve means, a valve is formed with a valve body and a valve seat pressure-engaged with each other, and the valve means is opened by knocking a pressing portion at the rear end of the tubular casing so that a liquid is supplied to the applicator tip. A liquid discharge rate restricting chamber means is provided in front of the valve means, and an open end of a liquid flow passage connected to the discharge rate restricting chamber is positioned in the vicinity of the front portion of a liquid storage member provided at the back of the applicator tip.

PREFERRED EMBODIMENTS OF THE INVENTION

Figure 1:
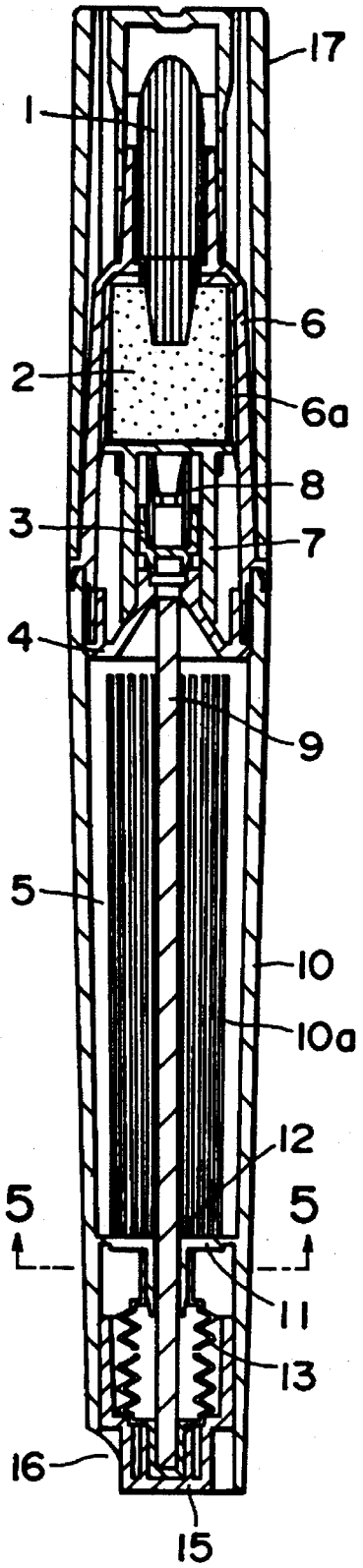
FIG. 1 is a longitudinal sectional view of a liquid discharge apparatus embodying the present invention.
Figure 2:
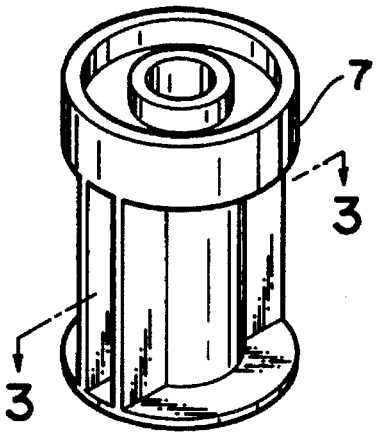
FIG. 2 is a perspective view of a support member constituting a liquid discharge rate restricting chamber in a preferred embodiment of the present invention.
Figure 3:
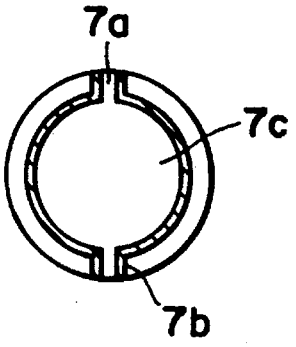
FIG. 3 is a cross-sectional view taken along the line 3—3 in FIG. 2.

Referring first to FIG. 1 of the drawings, a liquid discharge apparatus of the present invention has an applicator tip 1, a liquid storage member 2, a valve body 3, a valve seat 4, and a liquid chamber 5. The applicator tip 1 is inserted and firmly set in a front end opening of a front tubular casing portion 6 having a smaller diameter at the front end portion thereof and a larger diameter at the rear portion thereof, and the rear portion of the applicator tip 1 is disposed in a central bore in the liquid storage member 2 which is composed of cotton or other desired porous material with a capillary force smaller than that of the applicator tip 1. At the back of the liquid storage member 2, a support member 7 having a seat for a resilient member 8 and having a liquid discharge rate restricting member is provided. The support member 7 has a cylindrical body with a flanged bottom and having a substantially inverted U-shaped longitudinal section as shown in FIGS. 2 and 3. The support member 7 is directed toward the liquid storage member 2 and brought into contact with the stepped portion of ribs 6*a* in the front tubular casing portion 6. The open portion of the support member 7 is directed toward the valve, and the larger-diameter portion at the rear of the support member 7 is fitted in the inner surface of the front tubular casing portion 6, i.e., disposed in the front tubular casing portion 6.

Figure 4:
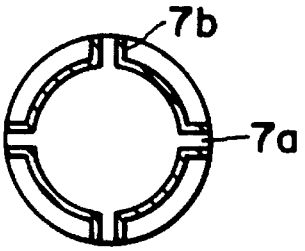
FIG. 4 is a cross-sectional view of the support member according to another embodiment of the invention.

The circumferential wall of the support member 7 is provided at the opposite portions thereof with slits 7*a* so that the slits extend vertically, and liquid guide members 7*b* are joined to the support member at the slits 7*a*. These slits 7*a* and liquid guide members 7*b* may be provided in four positions so that they extend in crosswise directions as shown in FIG. 4. Since a liquid flows from four sides toward the applicator tip 1 in this case, the liquid is supplied more uniformly. The valve body 3 is urged rearward by the resilient member 8 provided in the support member 7, and engaged with the valve seat 4 to form a valve means.

The valve body 3 has a larger diameter portion at the front side thereof so that it can be moved slidingly in the support member 7, whereby the occurrence of deflection of the valve body 3 is prevented when the valve means is opened and closed. The valve body 3 is further provided at its rear portion thereof with a recess in which the front end portion of a rod member 9 which will be described presently can be fitted, and this also serves to prevent the occurrence of deflection of the valve body 3. In this embodiment, these two structures are used to prevent the occurrence of deflection of the valve body 3 but, even when only one or the other of the structures is employed, an excellent effect is also obtained.

Figure 5:
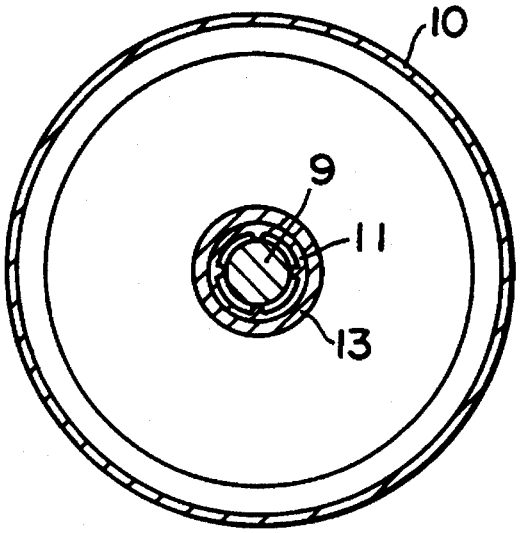
FIG. 5 is a cross-sectional view of the apparatus taken along the line 5—5 in FIG. 1.
Figure 6:
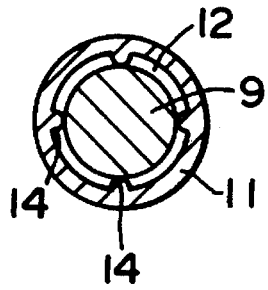
FIG. 6 is an enlarged cross-sectional view of a rod member and a central bore for receiving the rod member shown in FIG. 5.
Figure 7:
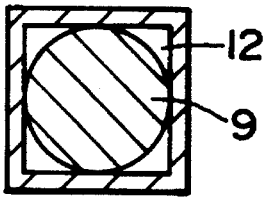
FIG. 7 is, similar to FIG. 6, an enlarged cross-sectional view of a rod member and a central bore according to another embodiment of the invention.
Figure 8:
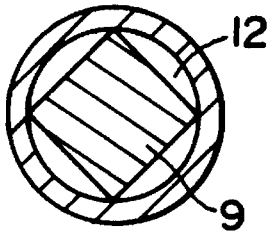
FIG. 8 is, similar to FIG. 6, an enlarged cross-sectional view of a rod member and a central bore according to a further embodiment of the invention.

At the back of the valve body 3, a rod member 9 is connected to the larger-diameter portion of the front tubular casing portion 6 and extends through the interior of a rear tubular casing portion 10 having a liquid storage portion 5 therein. This rear tubular casing portion 10 is provided in its inner surface with a plurality of lengthwise extending grooves 10*a* so that the residual quantity of the liquid can be ascertained easily. The front end of the rod member 9 is positioned in the vicinity of the rear portion of the valve body 3, and the rear portion of the rod member 9 is passed through a central bore 12 in a partition 11 in the rear tubular casing portion 10 with a clearance formed between the rear portion and bore 12. The rear portion of the rod member 9 is fastened to the rear end of an elastic web 13 in the shape of an expansible bellows portion. The clearance between the rod member 9 and central bore 12 may be formed by utilizing a difference between the diameters thereof, and, in order to produce an effect of preventing the deflection of the rod member 9, it is preferable to form a plurality of lengthwise extending ribs 14 on the inner surface of the central bore 12 as shown in FIGS. 5 and 6, or form one of the rod member 9 and central bore 12 in a cross-sectionally circular shape and the other in a cross-sectionally square shape and then combine them with each other as shown in FIGS. 7 and 8. Even when lengthwise extending projections are provided on the rod member 9, the same effect can be obtained. Plastics such as polypropylene, polyethylene, nylon and a copolymer of ethylenevinyl acetate are examples of a material out of which the elastic web 13 is formed. A pressing portion 15 is fixed to the outer end of the elastic web 13. The pressing portion 15 is slidable with respect to the inner surface of the rear portion of the rear tubular casing portion 10.

A cap 17 is formed by connecting inner and outer cap members together by a connecting member. This connecting member is provided with a lengthwise extending through-bore so that, even if a user swallows it by mistake, the user is not choked. The purpose of forming the rear portion of the valve seat 4 conically is to enhance the assembly of the applicator elements without breaking it even if the front end portion of the rod member 9 deviates from the axis of the front tubular casing portion 6.

When a pressing force is applied to the pressing portion with the applicator elements in the positions shown in FIG. 1, the liquid chamber 5 is pressurized by web 13, and the rod member 9 advances to contact the valve body 3 and open the valve means. During this time, the liquid chamber 5 is in a pressurized state, and the liquid in the liquid chamber 5 is discharged through the clearance between the valve body 3 and valve seat 4 into a cylinder 7*c* of the support member 7. The liquid further flows through the slits 7*a*, which are provided in the circumferential wall of the cylinder 7*c*, the outer side of the guide members 7*b*, the spaces among the ribs 6*a*, which are provided on the inner surface of the front shaft 6, and the contact portions of the ribs 6*a* and to the applicator tip 1. The liquid discharge rate is restricted when the liquid flows out from the clearance between the valve body 3 and the valve seat 4 into the cylinder 7*c* of the support member 7, and further regulated in accordance with the dimensions of the slits 7*a* and the length of the guide members 7*b*.

At the beginning of the use of the liquid discharge apparatus, the liquid is supplied to the applicator member through the above-described flow passages. Since liquid discharge slits are formed in the support member 7, a part in which the liquid being supplied gathers most, the movement of the liquid does not stop, so that the liquid is supplied to the applicator tip 1 in a short period of time. If the liquid storage member 2 is surrounded by a non-liquid-permeable material, such as a high molecular weight material film, the liquid storage member 2 can easily be prevented from absorbing the liquid flowing along the inner surface of the front tubular casing portion 6. In the case where the pressing portion 15 is pressed during the use of the apparatus, so that a quantity of liquid that is not smaller than the quantity needed to saturate the applicator tip 1 is supplied thereto, the excess liquid permeates into the liquid storage member 2, which is provided at the back of the applicator tip 1, owing to the capillary action of the liquid storage member 2, and leakage of the liquid does not occur. When the liquid is discharged during use so that the quantity of the liquid in the applicator tip 1 decreases, the excess liquid permeating into the liquid storage member 2 is supplied to the applicator tip 1.

Figure 9:
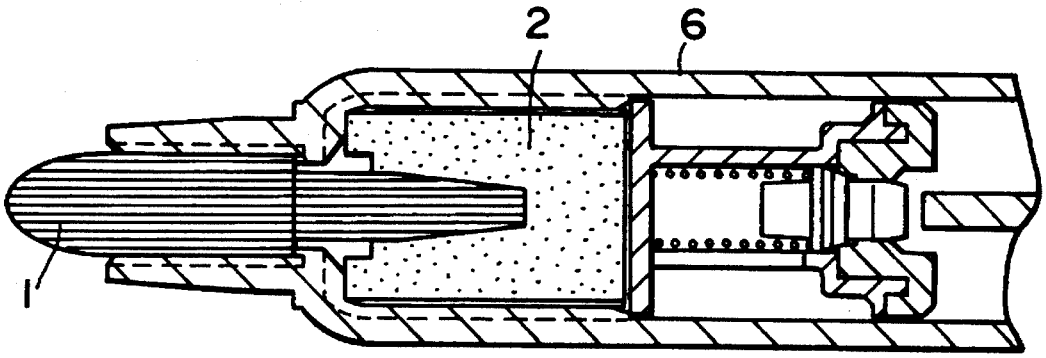
FIG. 9 is a longitudinal section of a modified example of a front portion of the liquid discharge apparatus according to the present invention.

FIG. 9 shows another embodiment of the invention which is similar to the above-described embodiment except that this embodiment is provided with a space, the capacity of which is smaller than the quantity of liquid needed to saturate the applicator tip 1, constituted by the ink flow passage in the front tubular casing portion 6, applicator tip 1 and liquid storage member 2. By the provision of this space, the liquid is supplied to the applicator tip 1 more smoothly.

Figure 10:
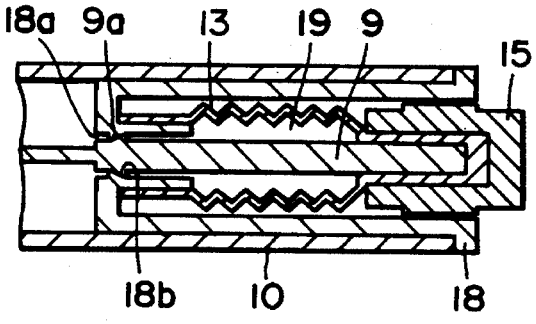
FIG. 10 is a longitudinal sectional view of a front portion of the discharge apparatus according to another embodiment of the invention.

FIG. 10 shows another embodiment of the invention in which the permeation of the liquid through the elastic web (FIG. 1) is prevented. A tail plug 18 has a central bore 18*a* and is inserted into the rear end portion of a rear tubular casing portion 10. A rod member 9 is provided with a tapering projection 9*a* having a diameter which increases in the rearward direction, and the projection 9 engages from the rear side a circumferential rib 18*b* provided on the inner surface of the central bore 18*a* to form a liquid-tight structure, whereby a sealed space 19 is formed within the elastic web 13. A pressing portion 15 is fixed to the outer end of the elastic web 13 so that the pressing portion 15 can be moved with respect to the inner surface of the rear portion of the tail plug 18. The other parts of this embodiment are substantially similar to the corresponding parts and elements of the above-described embodiments of the invention. In the non-use condition shown in FIG. 10, the liquid in the liquid chamber 5 (FIG. 1) is isolated from the interior 19 of the elastic web 13 owing to the liquid-tight engagement of the projection 9*a* and circumferential rib 18*b*, and the interior of the elastic web 13 forms a sealed space 19. Accordingly, the components of the liquid do not permeate through the elastic web 13. When a pressing force is applied to the pressing portion 15 to put the apparatus to practical use, the rod member 9 advances with its projection 9*a* passing over the circumferential rib 18*b* to open the valve means and supply the liquid in the liquid chamber 5 to the applicator tip 1.

Figure 11:
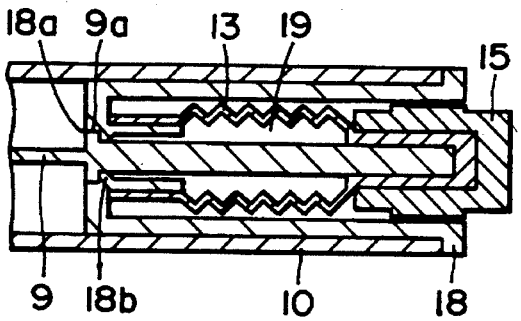
FIG. 11, similar to FIG. 10, is a longitudinal sectional view of the apparatus according to a further embodiment of the invention.

With reference to FIG. 11, a tapering projection 9*a* which has a decreasing diameter toward the rear end portion is provided instead of the projection in the previous embodiment of the invention. This tapering projection 9*a* contacts from the front side a circumferential rib 18*b*, which is provided on the inner surface of a central bore 18*a* in the front portion of a tail plug, owing to the resilient force of the elastic web 13 to form a liquid-tight structure, so that a sealed air space 19 is formed in the elastic web 13. When this modified example is in a non-use state, the components of the liquid do not, of course, permeate through the elastic web 13. Even when this example is in use, a rod member 9 moves back, if the pressing portion 15 is released from the pressing force applied thereto, due to the resilient force of the elastic web 13, and the projection 9*a* and circumferential rib 18*b* engage each other to enable a sealed portion 19 to be formed again in the interior of the elastic web 13. Therefore, the permeation of the liquid in the liquid chamber 5 through the elastic web 13 can be reduced.

Figure 12:
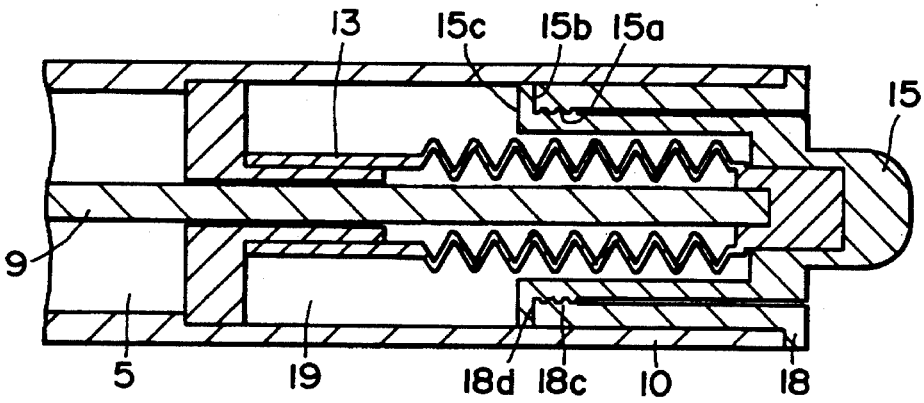
FIG. 12, similar to FIG. 10, is a longitudinal sectional view of the apparatus according to a still further embodiment of the invention.

In a further embodiment of the invention shown in FIG. 12, a pressing member 15 is provided in the outer surface of the front portion thereof with a threaded portion 15*a*, which is engageable with a threaded portion 18*c* of a tail plug 18 fixed to the open rear end portion of a reef tubular casing portion 10. When these threaded portions 15*a*, 18*c* are disengaged from each other, the pressing member 15 becomes slidable with respect to the inner surface of the tail pug 18. When the pressing member 15 and the tail plug 18 are engaged with each other, an annular rib 15*b* provided on a front end flange portion 15*c* of the pressing member 15 and the front end surface 18*d* of the tail plug 18 are forcibly engaged with each other in a liquid-tight condition to form a body 19 of sealed air on the outer side of an elastic web 13. The other parts of this example are substantially similar to the corresponding parts of the previously described examples.

An operation of the structure of the embodiment of FIG. 12 will be described. The pressing member 15 is turned so as to disengage the pressing member 15 and tail plug 18 from each other. When the pressing member 15 is then pressed forward, the elastic web 13 contracts, and the pressure in a liquid storage portion 5 increases to cause a rod member 9 to be displaced forward, and a valve means be opened. Consequently, the liquid in the liquid chamber 5 is supplied to the applicator tip 1.

Figure 13:
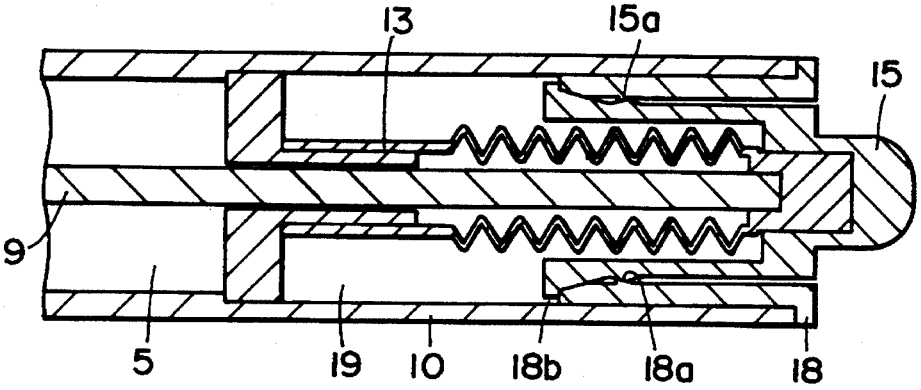
FIG. 13, similar to FIG. 10, is a longitudinal sectional view of the apparatus according to another embodiment of the invention.

In FIG. 13, the front part of a pressing portion 15 tapers so that the outer diameter thereof decreases in the rearward direction, and the outer surface of the pressing portion 15 and the inner surface of a tail plug 18 are provided with ribs 15*a*, 18*a* instead of threads. When the rib 15*a* on the pressing portion 15 passes over and engages the rib 18*a* on the tail plug 18, a rib, which is very small and not shown in the drawing, on a tapering part of the pressing portion 15 and a front portion 18*b* of the tail plug 18 are press-fitted to each other in a liquid-tight manner to form a sealed air space 19. In the embodiment of FIG. 13, it is not necessary to turn the pressing portion 15 when the apparatus is used.

Figure 14:
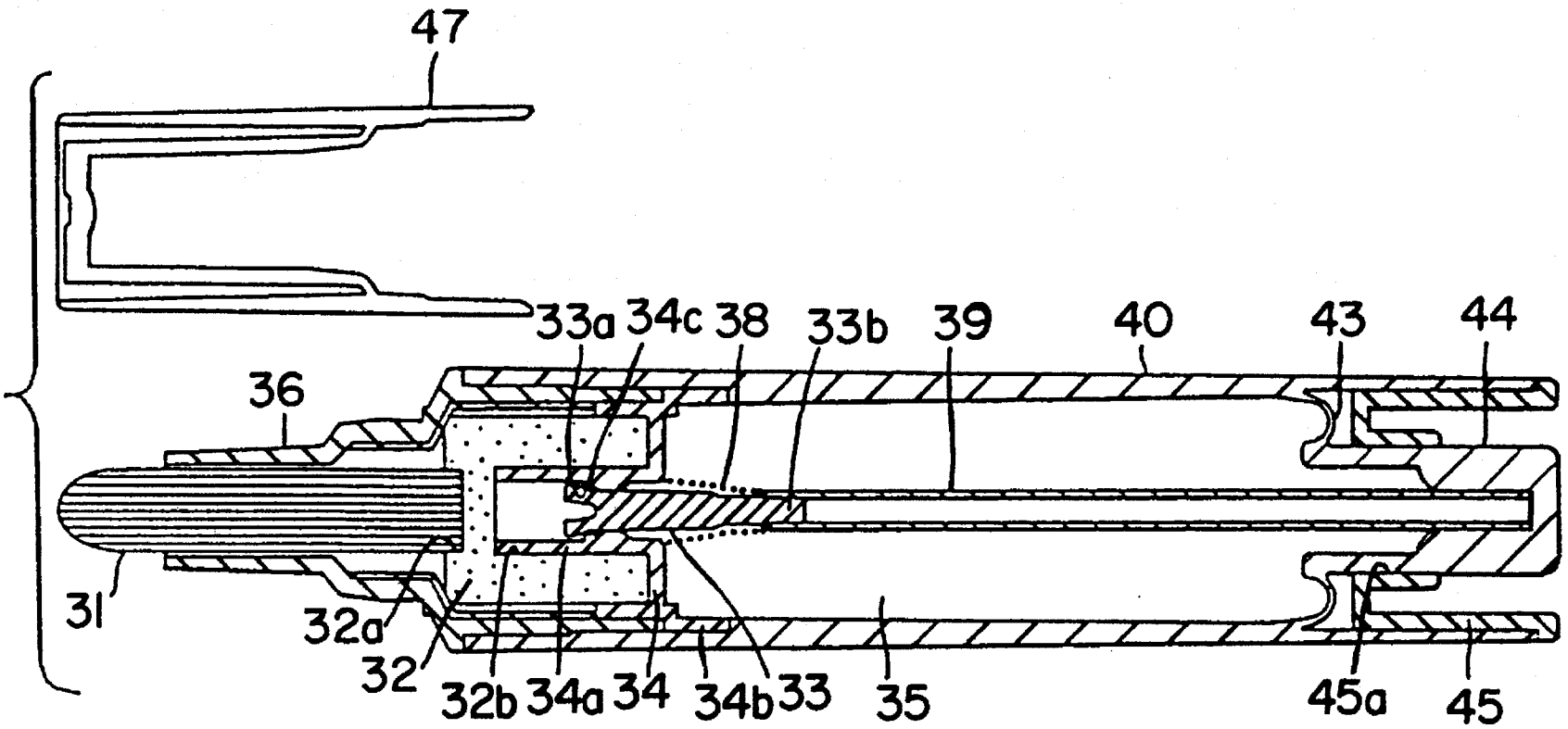
FIG. 14 is a longitudinal sectional view of still another embodiment of the invention.

Referring to FIG. 14 showing another embodiment of the invention, an applicator tip 31 is inserted into a front tubular casing portion 36 so that its front end portion projects from a front end of the front tubular casing portion 36 and its rear end is inserted into a concentric front recess 32*a* of a liquid storage member 32 which is composed of cotton or other desired porous material with a capillary force (or attraction) smaller than that of the applicator tip 31. The liquid storage member 32 has a concentric rear recess 32*b* which is deeper than that of the front recess as illustrated. Into the rear recess 32*b* is disposed a valve seat 34 which has a tube portion 34*a* and a flange portion 34*b*, with the tube portion 34*a* snugly inserted and fitted into the rear recess 32*b*. The valve seat 34 has a seat portion 34*c* on the tube portion 34*a*, the seat portion 34*c* extending radially inwardly from a surface of the tube portion 34*a*. The tube portion 34*a* has a rear end which receives an end of a spiral spring 38, the other end of which is received by a rod member 39.

The flange portion 34*b* of the valve seat 34 is held between a rear end of the front tubular casing portion 36 and a shoulder or step portion on an inner wall of a rear tubular casing portion 40. A valve body 33 has, at its front portion, a forwardly diverging tapered portion which has a valve portion 33*a*, and a rod portion having a connecting portion 33*b* at the rear end. The valve body 33 is rearwardly spring-biased by the spring 38 so that the valve portion 33*a* is resiliently contacted with the seat portion 34*c* of the valve seat 4 to thereby form a valve mechanism. The forwardly diverging portion of the valve body 33 is axially slidably fitted in the tube portion 34*a* and, therefore, the valve body 33 is prevented from being unfavorably displaced in the radial direction.

At the rear portion of the valve body 33, a rod member 39 is provided which has a front end connected to the rear end of the connection portion 33*b* of the valve body 33. The rod member 39 is positioned in the rear tubular casing portion 40 which has a liquid chamber 35. The rod member 39 is connected at its rear end to a pressing member 44 which has a diameter smaller than the diameter of the rear tubular portion 40.

The pressing member 44 is disposed concentrically at a rear end of the rear tubular portion 40 and is formed in a unitary structure with a thin wall resilient portion 43 having an arc shape in longitudinal section. By the thin wall resilient portion 43, the pressing member 44 is movable in the axial direction toward the applicator tip 31 when the pressing member 44 is pressed.

An end plug 45 having a central bore 45*a* is press-fitted into the rear end of the rear tubular casing portion 40. The pressing member 44 is slidably inserted into the central bore 45*a* and thus the central bore 45*a* serves as a guide for movement of the pressing member 44.

In the embodiment of FIG. 14, the rod member 39 has been described as fixed to the valve body 33 and pressing member 44, but it will be appreciated that the rod member 39 may be fixed to either the valve body 33 or the pressing member 44.

In FIG. 14, reference numeral 47 designates a cap adapted to fit over a front end of the applicator to protect the applicator tip 41. The cap is designed to be fit over the rear end of the applicator, when the applicator is in use, so that the cap aids in pressing the pressing member 44.

An operation will be described. When the pressing member 44 is pressed inwardly against the resilient force of the spring 38, the pressing member 44, rod member 39 and valve body 33 are advanced by the aid of the thin wall resilient portion 43 so that the valve is opened. At this moment, the liquid chamber 35 is pressurized by the advance of the pressing member 44, and a liquid in the liquid chamber 35 is discharged through a gap between the valve portion 33*a* and the seat portion 34*c* into the tube portion 34*a* of the valve seat 34. The discharged liquid is then fed through a front opening of the tube portion 34*a* and to the liquid storage member 32 through a bottom of the rear recess 32*b*. Immediately thereafter, the liquid which is fed into the front portion of the liquid storage member 32 is supplied to the applicator tip 31 before the liquid storage member 32 is entirely filled with the liquid because the liquid storage member 32 has a smaller capillary force than the applicator tip 31 as described above and because the rear recess 32*b* of the liquid storage member 32 is covered with the tube portion 34*a* of the valve seat 34. Thus, the liquid discharged through the valve is fed immediately to the applicator tip so that the tip contains the liquid ready for use. Excessive liquid supplied to the applicator tip is returned to, and stored in, the liquid storage member 32. Thus, no leakage of the liquid occurs.

What is claimed:

1. A liquid discharge apparatus comprising:

a tubular casing having a front end and a rear end;

an applicator tip mounted in said front end of said tubular casing, said applicator tip having a front end and a rear end;

an actuator button mounted to said rear end of said tubular casing, said actuator button having a pressing portion;

a thin wall resilient portion integrally connecting said tubular casing and said pressing portion so that said pressing portion is axially movable in said tubular casing;

a liquid storage member mounted in said tubular casing and having a front end and a rear end, said front end of said liquid storage member being connected with and in fluid communication with said rear end of said applicator tip, said rear end of said liquid storage member having a recess formed therein, and said liquid storage member comprising a porous material;

a valve including a valve body connected to said actuator button, said valve body being movably mounted in said recess formed in said rear end of said liquid storage member;

a liquid discharge restriction chamber having a tube portion fitted in said recess formed in said rear end of said liquid storage member, said tube portion having a valve seat engageable by said valve body; and a liquid chamber defined in said tubular casing between said actuator button and said applicator tip.

2. A liquid discharge apparatus as recited in claim 1, wherein said porous material of said liquid storage member has a capillary attraction smaller than that of said applicator tip.

3. A liquid discharge apparatus as recited in claim 1, wherein said porous material of said liquid storage member has a capillary attraction smaller than that of said applicator tip such that said liquid storage member comprises a means for delivering liquid from said liquid chamber to said applicator tip before said porous material of said liquid storage member is entirely filled and, when excessive liquid is supplied to said applicator tip, for storing the excessive liquid in said porous material.

4. A liquid discharge apparatus as recited in claim 1, wherein said actuator button comprises a means for moving said valve body.

5. A liquid discharge apparatus as recited in claim 4, wherein said actuator button further comprises a means for pressurizing liquid in said liquid chamber and forcing the liquid through said valve and into said liquid storage member.

6. A liquid discharge apparatus as recited in claim 1, wherein said actuator button comprises a means for pressurizing liquid in said liquid chamber and forcing the liquid through said valve and into said liquid storage member.

7. A liquid discharge apparatus as recited in claim 1, further comprising a spring biasing said valve body toward said valve seat.

8. A liquid discharge apparatus as recited in claim 1, wherein said liquid storage member further has a recess formed in said front end thereof, said rear end of said applicator tip being mounted in said recess formed in said front end of said liquid storage member; and said recess formed in said front end of said liquid storage member is shallower than said recess formed in said rear end of said liquid storage member.

9. A liquid discharge apparatus as recited in claim 1, wherein said liquid storage member is mounted between said liquid chamber and said applicator tip.

* * * * *